United States Patent [19]

Monget et al.

[11] Patent Number: 4,463,652

[45] Date of Patent: Aug. 7, 1984

[54] HIGH-SPEED BRAIDING

[75] Inventors: Pierre Monget; Etienne Naffrechoux, both of Crepy en Valois, France

[73] Assignee: Compagnie Francaise des Isolants, Paris, France

[21] Appl. No.: 190,678

[22] Filed: Sep. 25, 1980

[51] Int. Cl.[3] ..... D04C 1/00

[52] U.S. Cl. ..... 87/1; 57/295; 87/23

[58] Field of Search ..... 87/1, 23; 57/295–297, 57/309, 249, 250, 240, 241

[56] References Cited

U.S. PATENT DOCUMENTS

| | | | |
|---|---|---|---|
| 2,245,824 | 6/1941 | Roesch | 87/1 |
| 2,257,649 | 9/1941 | Pierce | 87/1 |
| 2,318,457 | 5/1943 | Bouhuys | 87/1 |
| 2,464,536 | 3/1949 | Solliday et al. | 57/309 |
| 2,664,409 | 12/1953 | Aickin et al. | 87/1 UX |
| 2,667,804 | 2/1954 | Boyer et al. | 87/1 |
| 2,684,309 | 7/1954 | Deardurff | 87/1 |
| 2,686,451 | 8/1954 | Shafer | 87/1 |
| 2,775,860 | 1/1957 | Morrison | 87/1 X |
| 2,824,485 | 2/1958 | Gregory | 87/1 |
| 3,653,295 | 4/1972 | Pintard | 87/23 X |
| 4,192,663 | 3/1980 | Schmandt et al. | 118/238 X |

FOREIGN PATENT DOCUMENTS

| | | |
|---|---|---|
| 2036096 | 1/1972 | Fed. Rep. of Germany . |
| 468249 | 7/1937 | United Kingdom . |
| 502643 | 3/1939 | United Kingdom . |
| 871833 | 7/1961 | United Kingdom . |
| 873716 | 7/1961 | United Kingdom . |
| 891358 | 3/1962 | United Kingdom . |
| 926922 | 5/1963 | United Kingdom . |
| 928697 | 6/1963 | United Kingdom . |
| 1157046 | 7/1969 | United Kingdom . |
| 1420613 | 1/1976 | United Kingdom . |
| 1531652 | 11/1978 | United Kingdom . |

*Primary Examiner*—John Petrakes

*Attorney, Agent, or Firm*—Edith A. Rice; Herbert G. Burkard; Gail-Deanna Salasny

[57] ABSTRACT

An overcoatable machine-made braid may be formed at high-speeds and directly from producer's low-twist, single-yarns of continuous filament, inorganic materials by this process which treats the yarn prior to or during braiding with a lubricant liquid. The treatment enables such single-yarns, which tend to be brittle, to be processed on modern high-speed braiding machines without excessive fibrillation of the yarn, duplicating overcoatable braid constructions using costlier plied twisted-pair-yarns. Additionally, the treatment enables advantage to be taken of the intrinsically greater width to depth ratio of single-yarns compared to their braid-production equivalent twisted-pair-yarns. The resulting braids are lighter in weight, have a finer hand and can be more smoothly overcoated.

29 Claims, 1 Drawing Figure

HIGH-SPEED BRAIDING

BACKGROUND OF THE INVENTION

This invention relates to braiding, and more particularly to high-speed single-yarn braiding.

The verb braid originally meant to intertwine or interlace three (or more) strands into a flat band or ribbon by repeatedly diagonally crossing a first strand and then a second strand alternately and under a central strand and then under the opposite strand. While such a meaning is still correct, the term braid today also encompasses the more or less tubular shaped article formed by feeding a plurality of strands off of multiple carriers and braiding the strands circumferentially around a mandrel at a controlled angle. In machine braiding the mandrel is fed through the center of the machine at a uniform rate with the machine operating like a maypole with the carriers working in counter rotating pairs with respect to the mandrel to accomplish the over and under braiding sequence. Usually, although not invariably, the mandrel is removed after formation of the braid.

Braids are conventionally produced on braiding machines as flat band or tubular constructions for a variety of purposes, including thermal and electrical insulation. For some end uses the resulting braids receive an overcoating to enhance their physical and electrical properties. Overcoating materials are usually curable organic liquids, such as varnishes, polyvinyl chloride polymers, acrylic polymers, silicone polymers, or urethane polymers, and are applied to the formed braid, which braid may of necessity be pretreated with an adhesion-promoting primer.

Yarns are of two basic types; staple filament and continuous filament. Wool and cotton fibers, as well as man-made organic or inorganic fibers if cut to a short defined length, are examples of the staple type. Individual fibers of typically 8 to 15 inches in length form the staple filament which must be spun (i.e. plied and twisted) together to form a yarn or cord. Silk fibers and extruded man-made, organic or inorganic fibers are examples of continuous filaments. Each individual fiber is of such length that it extends substantially throughout the length of any continuous filament strand.

Yarns for braiding can be of either the staple filament type or the continuous filament type depending upon the specific product application. Mechanical braiding, especially at modern high speeds, currently on the order of 420 yarn interlacings i.e. "picks" per minute, tends to result in the formation of individual fibrils (called whiskers) which project laterally from the yarns. Fibrillation is due, for example, to the frictional, tensional and shear stresses encountered by the yarns as they are machined. Fibrillation is thus predictably more prevalent in staple filament yarns, in lighter weight yarns and for more brittle materials, especially inorganic materials.

For many applications, fibrillation is not objectionable and might even be encouraged as preferable, but that is not the case for braids which are to be overcoated. Broken filament ends or staple fibers which have become untwisted, project laterally from the yarns and interfere with the overcoating process and thereby tend to detract from the aesthetic, physical and electrical properties of the overcoated braid. Continuous filament yarns are accordingly clearly preferable to staple filament yarns for overcoatable braids, especially braids of inorganic materials.

Solid waxy substances have long been used to unify yarns and to reduce frictional breakage. Wet lubrication with, for example, soap-solutions or hydrocarbon and other oils, as a means of softening and lubricating natural fibers and man-made organic fibers is also well known. Inorganic yarn materials such as glass, being relatively impervious, are usually given a solid, starch-oil based size coating during their formation and assembly into yarns. Manufacturers typically spray a size formulation solution onto the extruded filaments which dries to a finely divided, powdery solid and which improves subsequent handling and fabrication operations, said size formulation being starch-based and usually containing solid lubricants such as silanes or hydrocarbon waxes.

For applications that do not require overcoating, sized, continuous filament, inorganic single-yarns can be braided, but it has been a longstanding problem in producing overcoatable braids of inorganic yarn materials that the level of filament breakage which occurs at modern braiding speeds is sufficient to significantly and intolerably detract from the properties of the coated braid as aforesaid. This problem is especially severe with light to medium weight yarns (less than 600 tex). It should be noted however, that it is possible to braid sized single-yarns and obtain an overcoatable surface, if the braiding machine is operated at very low speeds on the order of 100 yarn interlacings per minute; speeds which are high uneconomical in today's marketplace.

Variations in size formulations and coating weights have failed to provide satisfactorily overcoatable braid surfaces at pragmatically high machine speeds. As a result, it has been the general practice in the commercial overcoatable braiding art to braid strands consisting of twisted-pairs of continuous, multi-filament, inorganic yarns, such as glass, to control breakage and fibrillation. Such twisted-pair-yarns are considerably more expensive and provide a heavier-weight braid than single-yarns, but are none-the-less more economical than production at low speeds.

The greater expense of twisted-pair-yarn is largely due to the separate twisting and plying operations on specialized machinery required to obtain the yarn. If a balanced yarn (i.e. one which will not unravel) is desired, the operations are more complex and hence even costlier. In any event, economy of material consumption is unfavorable compared to single-yarns due to the loss of length upon twisting and to the fact that the width to depth ratio is much less for twisted-pair-yarns, which requires that a greater density of strands be used to obtain an equivalent braiding surface for overcoating purposes.

SUMMARY OF THE INVENTION

An object of the present invention is to make feasible the high-speed machine braiding of continuous filament, single-yarns of inorganic materials, resulting in a satisfactorily overcoatable braid surface, thus eliminating the need to ply and twist single-yarns in separate operations, into twisted-pair-yarns.

A further object of the present invention is to make feasible the high-speed machine braiding of continuous filament, single-yarns of inorganic materials without requiring that the solid size coating present on the yarns as they are supplied by the producer be removed.

A further object of the present invention is to make feasible the high-speed machine braiding of light to medium weight continuous filament, single-yarns of inorganic materials.

A further object of the present invention is to produce at economically high-speeds, an overcoatable single-yarn braid which is lighter in weight than was heretofore possible, thus taking advantage of the greater width to depth ratio intrinsic to single-yarns for a braid surface veneer equivalent to or better than that of twisted-pair-yarns, for applications wherein such lighter weight and/or the attendant savings in cost of materials is advantageous.

A further object of the present invention is to produce at economically high-speeds, an overcoatable single-yarn braid which has a finer hand and can be more smoothly overcoated than was heretofore possible.

These and other objects and advantages of the instant invention will be further discussed or made apparent to those skilled in the art of commercial overcoatable braiding from the following detailed description thereof taken in conjunction with embodiments, examples, and illustrations thereof set forth hereinafter.

Briefly, the present invention accomplishes these and other objects and advantages by providing a process for high-speed machine braiding of single-yarns of continuous filament, inorganic materials to produce a braid which can be satisfactorily overcoated if desired. The process comprises the steps of applying to the single-yarns a lubricant liquid selected for the yarns in question to be capable of substantially preventing the occurence during braiding of filament breakage and fibril formation which detracts from the overcoatability of the finished braid because of lateral projection of fibrils therefrom, and braiding the yarns carrying said lubricant liquid by machine at speeds at or above 100 yarn interlacings per minute. The lubricant liquid application most preferably takes place during winding of the yarns onto braiding machine bobbins, but application immediately prior to or during braiding is also feasible. The additional step of removing the lubricant liquid after braiding by, for example, flame treatment, may be desirable.

The present invention also provides a flat or tubular single-yarn braid produced by the aforesaid process.

BRIEF DESCRIPTION OF THE DRAWING

For a better understanding of the invention reference should be had to the accompanying drawing, wherein.

DETAILED DESCRIPTION OF THE INVENTION

Figure 1:
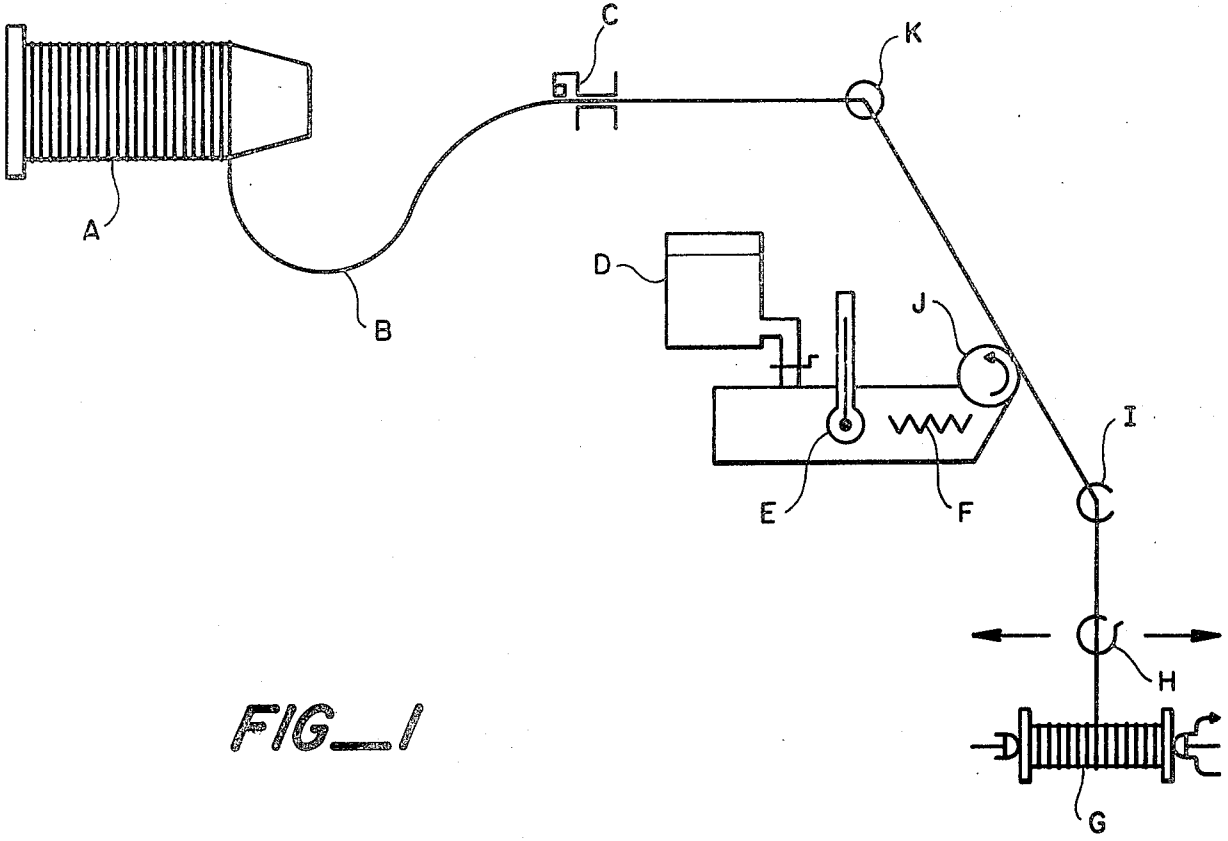
FIG. 1 is a symbolically schematic diagram of the process steps according to the present invention.

Contrary to what was heretofore generally considered feasible, the present invention provides for the first time a satisfactorily overcoatable, high-speed machine-made braid formed at speeds at least high enough to be economically pragmatic and formed directly from continuous filament single-yarns of inorganic materials, which tend to be brittle, abrasive or fragile. The single-yarns utilized in the present invention can suitably be either continuous mono-filament or continuous multi-filament or a blend thereof. A braid fabricated in accordance with the present invention is found to be substantially free from fibrillar portions projecting from the braid and hence may be readily overcoated. Thus the present invention provides a surprisingly simple solution to a longstanding problem which was altogether unexpected because of the relatively impervious nature of inorganic materials.

It is a significant commercial advantage of the present invention that untwisted multi-filament single-yarns may be used. The term "untwisted" is intended to encompass yarns, whether mono-filament or multi-filament, having fewer than 40 twists per meter, such yarns also being commonly referred to as "low-torsion" yarns or producer's low-twist yarns, hereinafter referred to as "single-yarns".

In practicing the present invention, it is often feasible for substantially all the yarns utilized in forming the braid to be the said continuous single-yarns. In many cases it will be preferable for substantially all the yarns in the braid to be multi-filament, continuous single-yarns, including rovings. Suitable multi-filament yarns can contain any convenient number of individual filaments, 300 to 400 filaments per yarn being conventional.

The braided yarns, if desired, can be treated with primer to promote adhesion of any coatings to be subsequently applied to the braid, particularly in the case of glass fiber yarns or yarns of other materials to which many coatings have difficulty in adhering without prior surface treatment of the yarn. Indeed the lubricating liquid of the present invention might serve in some cases as the adhesion promoting primer with or without additional chemical treatment.

The braiding process per se of the present invention does not differ from conventional braiding in that conventional braiding machines are utilized but rather in the treatment of the yarn immediately prior to braiding which treatment enables single-yarn to be processed on modern high-speed braiding machines without excessive fibrillation of the yarn.

The braiding process according to the present invention comprises the steps of contacting single-yarns with a lubricant liquid material which is different from, and in addition to, any material which may be applied for the purpose of initially forming the yarns themselves, if any, such lubricant material being capable of substantially preventing filament breakage and the formation during braiding of fibrils projecting from the yarns, and subsequently braiding the yarns thereby producing a braid which is substantially and acceptably free from fibrils (whiskers). The additional step of removing the applied lubricant liquid material may be desirable for some applications.

The braiding of single-yarns as opposed to twisted-yarn-pairs has the advantages of surprisingly increasing production efficiency, together with reduced cost. Because the single-yarns intrinsically tend to have a greater width to depth ratio than their equivalent twisted-pair-yarns, the resulting braid has a finer hand (i.e. is softer and smoother to the touch) and can be more smoothly coated, resulting in improved characteristics and further contributing to production efficiency. Twisted-pair-yarns are denser in the sense of compactness. They provide a surface veneer with less width and hence, comparatively, are heavier in weight and cannot ordinarily be as smoothly coated.

It will be understood that the terms "lubricant liquid" and "lubricant liquid material" are not necessarily restricted to materials traditionally regarded as lubricants, which materials are traditionally utilized in connection with metal to metal contact. The terms "lubricant liquid" and "lubricant liquid material" are accordingly to be construed as covering any formulation of materials which facilitates the braiding of the mono- or multi-filament single-yarns by suppressing displacement or breakage thereof to thereby substantially reduce or prevent the occurrence of projecting filament portions. In further illustration of this point, materials such as the salt of a fatty acid amide and a fatty acid ester, glycol polyalkylene ethers, fatty acid amide plus polyglycol ether, sulphonated fatty acids, fatty acid amides, polyglycol ether sulphates, polyethylene emulsions, acrylic polymers, polyvinyl acetate emulsions, acrylic polymers, polyvinyl acetate emulsions, and silicone oil are sometimes suitable "lubricant liquid materials" for use in connection with particular yarns to be braided. Unsatisfactory performance of certain combinations of yarns and lubricants, for example, silicone oils on glass fiber yarns is believed to be due to excessive static electricity generation. Such unsatisfactory performance can sometimes be overcome by formulation with electrically conductive additives, designed to alter the electrostatic characteristics of the liquid/fiber interaction such as quartenary ammonium salts dissolved in a suitable solvent vehicle. This is a matter to be determined by simple trial and error for each particular kind of yarn to be braided.

References to the braid being "substantially free from", or to the lubricant "substantially preventing," projecting individual filament portions will be clear to persons familiar with the field of braiding technology. It is impracticable to specify exactly what is an acceptable level of projecting filament portions but the normal criteria in this field for judging satisfactory braid surfaces subsequent coating quality and performance of the overcoated braid will readily enable suitably skilled workers to determine whether the occurrence of projecting filament portions has been supressed to an acceptable degree.

As aforesaid, it is preferable for substantially all the yarns to be the said continuous single-yarns, and it is also preferable for substantially all the yarns to be said continuous multi-filament single-yarns. The yarns are preferably contacted with the lubricant material during winding of the yarns onto braiding machine bobbins, which bobbins are subsequently inserted in the braiding machine in the usual way. Alternatively, but less preferably, the lubricant liquid may be applied to the yarn either after it leaves the bobbin but before it enters the braider or during braiding, by means of, for example, a spray nozzle.

The amount of lubricant liquid material to be applied, and the other operating conditions are adjusted to suit the precise yarn in question. Pick-up of about 2 to 6%, preferably at least about 3% of lubricant liquid by weight based on the dry weight of the yarn being preferred for glass filament yarns using an oily hydrocarbon lubricant, for example. The method by which the lubricant is contacted with the fibers is not critical, one convenient method being the use of a "licking" roll rotating in a bath of the lubricant liquid material (preferably warmed to a temperature above 25° C.) the yarn touching against the "licking" roll to pick up a coating of the lubricant. However, other methods such as spraying or complete submersion of the yarn in the lubricant material can be used. Alternatively, a bobbin wound with the yarn may be partially or totally immersed in the lubricant liquid. The amount of lubricant picked up by the yarn may in any event be adjusted by mechanical or pneumatic means if desired. In a preferred version of the present invention, the braiding process includes the additional step of removing the lubricant liquid material after braid formation. This may conveniently be done by flame-treatment of the braid in the case where the braid is formed from heat-resistant yarns, for example, glass fiber yarns. Alternatively, other removal methods, such as a solvent extraction may be used.

The lubricant liquid material is preferably an oily material having a relative density of at least 0.8 at 20° C. The lubricant preferably has a kinematic viscosity of from about 3 to about 35 centistokes at 20° C.

The most preferred lubricant comprises saturated hydrocarbon oils i.e. hydrocarbons containing less than about 5% of aromatic hydrocarbons and having a relative density within the range from 0.8 to 0.9 at 20° C. and a kinematic viscosity within the range from about 3 to about 35 centistokes at 20° C. These preferred hydrocarbons are known commercially as "paraffinic oils" or "Codex Vaseline" or "hemi-white and white Vaseline oils."

The lubricant is preferably applied to the yarns at a temperature above about 25° C., the temperature influencing to some extent the amount of lubricant picked up by the yarn.

It will be understood that the lubricant liquid materials may be applied alone or in mixtures with other lubricants or diluents to suit each particular case. It will also be understood that the terms "liquid" or "liquid materials" refer to formulations which are liquids or semi-liquids at normal ambient temperatures, but are liquid under the conditions of their application to the yarns and of the braiding operation.

When it is required to apply to the yarn a primer to promote adhesion of subsequently applied coatings to the braid, the primer may conveniently be applied for some yarn during the aforementioned winding of the yarn onto the braiding bobbins, preferably in combination with the application of the lubricant material.

The present invention can be utilized to improve the braiding of substantially any multi-filament yarns which withstand badly the stresses to which they are subjected on braiding machines, and the present invention is therefore particularly useful in connection with low-torsion yarns of materials such as carbon fiber or of brittle, abrasive or fragile materials, such as ceramics, silica, and glass. Yarns containing 300 to 400 filaments per yarn are commonly used. It may be advantageous to form braids from a blend of types of inorganic materials. Thus, each yarn may be a blend of filaments of two or more inorganic material types or alternately two or more types of inorganic yarns may be blended.

This invention is particularly valuable inasmuch as it facilitates braiding on high speed braiding machines, some modern machines being capable of making 420 interlacings per minute or more.

The invention may be more fully understood by reference to the accompanying drawings, which show by way of Example one way of carrying out the present process.

Referring to FIG. 1, the yarn (B) is unwound on a bobbin (A) on which it is supplied and is fed through a suitable braking and tensioning device (C) from which it passes, via a suitable guide member (K), to contact the licking roll (J) and thence to guides (I) and (H), the guide (H) moving to and fro as indicated by the arrows to distribute the yarn on the the braiding machine bobbin (G) in the usual way.

Between the guide members (K) and (I) the yarn contacts the licking roller (J) which is partly immersed in a bath of the lubricant liquid material and is rotating in a direction counter to the direction of movement of the yarn, as indicated by the curved arrow.

The lubricant material is maintained at a suitable temperature, for example 30° C., by suitable control means symbolically illustrated by heater (F) and thermometer (E), and an adequate level of the lubricant liquid material is maintained by reservoir (D).

The braiding machine bobbins thus containing the wet lubricated yarns are then placed on the spindles of a braiding machine, and the yarn is transformed into braids in the usual way, with a substantially reduced degree of filament breakage compared with unlubricated sized single-yarns or even in some cases with twisted-pair-yarns.

Specific Examples of this process will now be described in more detail, as a further illustration of the invention.

EXAMPLE 1

Sized glass filament "single"-yarns identified by the manufacturer's No. EC9 102 Z 20 (ECG 49 1/0 0.5 Z) were wound onto braiding bobbins in the manner generally described above with reference to FIG. 1, using a suitable braking tension determined by the usual criteria. The yarn was wound at a linear speed of 200 to 300 meters per minute, and was contacted with the aforementioned lubricant hydrocarbon oil MPW 2H (from ETS Moulin) at a temperature of 30° C. with the licking roller having a diameter of 60 mm and rotating at a speed of 10 revolutions per minute.

Under these conditions, the glass filament yarn picked up 3% by weight of the lubricant, based on the yarn dry weight, and was successfully braided on a braiding machine capable of 420 yarn interlacings per minute. After annealing and de-sizing by flame treatment, the braid was found to be substantially free of the lubricant liquid and substantially free of projecting filament ends, and was considered to be quite satisfactory for application of further coatings in known manner.

The aforementioned single yarn was thus able to replace twisted equivalent yarns EC9 34 X×35 150 (ECG 15 C ⅓ 3.8 S).

EXAMPLE 2

Example 1 was repeated, except that the MPW 2H oil was replaced as lubricant by the Codex Vaseline oil known as "SIDEPALINE 316" (from S.T.E. Chimiques de Gerland). Satisfactory results were again achieved, despite a tendency for a slightly increased occurrence of projecting filament ends.

EXAMPLE 3

Example 1 was repeated with the lubricant replaced by a blend of polyglycol ether and condensed fatty acids known as DURAN KG (from Hansa Werke). Acceptable results were again achieved, although the level of projecting filament ends was noticeably higher in this Example.

I claim:

1. A single-yarn braiding process for forming a braid from a plurality of continuous monofilament, or a plurality of continuous multifilament, inorganic, single-yarns said multifilament yarns having 300 to 400 filaments per yarn and less than 40 twists per meter, which process comprises:

(a) applying to said single-yarns a lubricant liquid selected to prevent filament breakage and fibril formation during braiding by contacting said yarns with said lubricant liquid during winding of said yarns onto braiding machine bobbins; and (b) machine braiding the lubricated yarns at a rate above 100 interlacings per minute to form a braid which is substantially free from fibrils projecting therefrom.

2. A single-yarn braiding process for forming a braid from a plurality of continuous monofilament, or a plurality of continuous multifilament, inorganic, single-yarns said multifilament yarns having 300 to 400 filaments per yarn and less than 40 twists per meter, which process comprises:

(a) applying to said single-yarns a lubricant liquid selected to prevent filament breakage and fibril formation during braiding by contacting said yarns against a licking roll, said licking roll rotating through a bath of said lubricant liquid; and (b) machine braiding the lubricated yarns at a rate above 100 interlacings per minute to form a braid which is substantially free from fibrils projecting therefrom.

3. A single yarn braiding process for forming a braid from a plurality of continuous monofilament, or a plurality of continuous multifilament, inorganic, single-yarns said multifilament yarns having 300 to 400 filaments per yarn and less than 40 twists per meter, which process comprises:

(a) applying to said single-yarns a lubricant liquid selected to prevent filament breakage and fibril formation during braiding in an amount such that the yarns when braided carry 2 to 6 percent by weight of lubricant liquid, based on the weight of the dry yarn; and (b) machine braiding the lubricated yarns at a rate above 100 interlacings per minute to form a braid which is substantially free from fibrils projecting therefrom.

4. A process in accordance with any one of claims 1, 2 or 3 wherein the lubricant liquid comprises an oily hydrocarbon.

5. A process in accordance with any one of claims 1, 2 or 3 wherein the oily hydrocarbon comprises a saturated hydrocarbon.

6. A process in accordance with any one of claims 1, 2 or 3 wherein the lubricant liquid comprises a blend of polyglycol ether and condensed fatty acids.

7. A process in accordance with any one of claims 1, 2 or 3 wherein the lubricant liquid comprises an oily material.

8. A process in accordance with any one of claims 1, 2 or 3 wherein the lubricant liquid is liquid or semiliquid at 15° C.

9. A process in accordance with any one of claims 1, 2 or 3 wherein the relative density of the lubricant liquid is at least 0.8 at 20° C.

10. A process in accordance with claim 9 wherein the relative density of the lubricant liquid is within the range from 0.8 to 0.9 at 20° C.

11. A process in accordance with any one of claims 1, 2 or 3 wherein the kinematic viscosity of the lubricant liquid is within the range from 3 to 35 centistokes at 20° C.

12. A process in accordance with claim 1 or claim 2 wherein the amount of lubricant liquid carried by the yarns when braided is at least 3 percent by weight of the dry yarn weight.

13. A process in accordance with any one of claims 1, 2 or 3 wherein the lubricant liquid is at or above about 25° C. when applied to the yarns.

14. A process in accordance with any one of claims 1, 2 or 3 wherein braiding is carried out on a braiding machine operated at speeds at or above 420 yarn interlacings per minute.

15. A process in accordance with any one of claims 1, 2 or 3 wherein substantially all of the yarns to be braided are monofilament single-yarns.

16. A process in accordance with any one of claims 1, 2 or 3 wherein substantially all the yarns to be braided are multifilament single-yarns.

17. A process in accordance with any one of claims 1, 2 or 3 wherein substantially all of the yarns to be braided are said single-yarns.

18. A process in accordance with any one of claims 1, 2 or 3 wherein said single-yarns themselves are substantially untwisted.

19. A process in accordance with any one of claims 1, 2 or 3 wherein said single-yarns are composed of glass filaments.

20. A process in accordance with any one of claims 1, 2 or 3 wherein said single-yarns are composed of ceramic filaments.

21. A process in accordance with any one of claims 1, 2 or 3 wherein said single-yarns are composed of silica filaments.

22. A process in accordance with any one of claims 1, 2 or 3 wherein said single-yarns are composed of carbon filaments.

23. A process in accordance with any one of claims 1, 2 or 3 wherein said single-yarns comprise a blend of filaments of two or more inorganic materials.

24. A process in accordance with any one of claims 1, 2 or 3 wherein said single-yarns comprise a blend of single-yarns of two or more inorganic materials.

25. A process in accordance with any one of claims 1, 2 or 3 wherein at least some of said single-yarns are less than 600 tex in weight.

26. A process in accordance with any one of claims 1, 2 or 3 wherein substantially all of said single-yarns are less than 600 tex in weight.

27. A process in accordance with any one of claims 1, 2 or 3 which further comprises:

(c) removing the lubricant liquid after braiding.

28. A process in accordance with claim 27 wherein the lubricant liquid is removed by flame treatment of the braid.

29. A single-yarn braid produced by a process according to any one of claims 1, 2 or 3.

* * * * *